US006272916B1

(12) United States Patent
Taniguchi et al.

(10) Patent No.: US 6,272,916 B1
(45) Date of Patent: Aug. 14, 2001

(54) ACOUSTIC WAVE TRANSMISSION SYSTEM AND METHOD FOR TRANSMITTING AN ACOUSTIC WAVE TO A DRILLING METAL TUBULAR MEMBER

(75) Inventors: Ryosuke Taniguchi; Takashi Shimada; Takahiro Sakamoto, all of Tokyo (JP)

(73) Assignees: Japan National Oil Corporation; Mitsubishi Denki Kabushiki Kaisha, both of Tokyo (JP)

( * ) Notice: Subject to any disclaimer, the term of this patent is extended or adjusted under 35 U.S.C. 154(b) by 0 days.

(21) Appl. No.: 09/415,258

(22) Filed: Oct. 12, 1999

(30) Foreign Application Priority Data

Oct. 14, 1998 (JP) ..... 10-292360

(51) Int. Cl.[7] ..... H04H 9/00; G01V 1/40

(52) U.S. Cl. ..... 73/152.47; 73/152.32; 73/862.333; 73/152.03; 340/854.4; 340/855.6; 367/82; 367/168; 175/40; 166/250.01

(58) Field of Search ..... 73/152.47, 152.32, 73/152.03, 587, 648, 643, 644, 862.333, DIG. 2, 773, 611, 668; 166/250.01, 250.07; 175/40, 50; 340/854.43, 855.6, 855.9; 367/162, 168, 159, 165, 156, 76, 81, 82

(56) References Cited

U.S. PATENT DOCUMENTS

| | | | | |
|---|---|---|---|---|
| 3,832,677 | * | 8/1974 | Brenden et al. | 340/15.5 TN |
| 3,900,827 | * | 8/1975 | Lamel et al. | 340/18 NC |
| 3,906,434 | * | 9/1975 | Lamel et al. | 340/18 NC |
| 3,961,308 | * | 6/1976 | Parker | 340/18 NC |
| 4,066,995 | * | 1/1978 | Matthews | 340/18 LD |
| 4,139,836 | * | 2/1979 | Chaney | 340/18 NC |
| 4,283,780 | | 8/1981 | Nardi | 367/82 |

(List continued on next page.)

FOREIGN PATENT DOCUMENTS

| | | |
|---|---|---|
| 53-101453 | 9/1978 | (JP) . |
| 56-125595 | 10/1981 | (JP) . |
| 64-27331 | 1/1989 | (JP) . |
| 552 833 | 7/1993 | (JP) . |
| 7-294658 | 11/1995 | (JP) . |
| 8-130511 | 5/1996 | (JP) . |
| WO89/10572 | 11/1989 | (WO) . |

*Primary Examiner*—Daniel S. Larkin
*Assistant Examiner*—David J. Wiggins
(74) *Attorney, Agent, or Firm*—Sughrue, Mion, Zinn Macpeak & Seas, PLLC

(57) ABSTRACT

An acoustic wave transmission system comprises an acoustic wave generating metal tubular member for converting information about the bottom of a borehole, which is obtained by a bottom hole sensor, into an acoustic wave. The acoustic wave generating metal tubular member includes a acoustic wave generating mechanism having at least a magnetostrictive oscillator which is mounted in a recess formed in an outer wall of the acoustic wave generating metal tubular member, and on which a compressive load is imposed by means of a pre-load mechanism using a vise. The magnetostrictive oscillator is constructed of a stack of thin plates each made of a metal magnetostrictive material having a property of increasing its dimensions when magnetized, the thin plates being bonded together by a heat-resistant adhesive. The magnetostrictive oscillator can thus have a buckling strength large enough to resist the compressive load imposed thereon by the pre-load mechanism and a stress due to a strain caused in itself. The acoustic wave generating metal tubular member further includes an excitation current supplier for supplying either a rectangular, sinusoidal, or triangular alternating excitation current modulated with the information about the bottom of the borehole and having a frequency that is half the carrier frequency of the acoustic wave, or a series of excitation pulses modulated with the information about the bottom of the borehole and having a pulse repetition rate that is equal to the carrier frequency of the acoustic wave, to an excitation winding wound around the magnetostrictive oscillator.

7 Claims, 11 Drawing Sheets

U.S. PATENT DOCUMENTS

| | | | | |
|---|---|---|---|---|
| 4,293,936 | * | 10/1981 | Cox et al. | 367/82 |
| 4,302,826 | | 11/1981 | Kent et al. | 367/82 |
| 4,467,659 | * | 8/1984 | Baumoel | 73/861.27 |
| 5,166,908 | | 11/1992 | Montgomery | 367/165 |
| 5,222,049 | | 6/1993 | Drumheller | 367/82 |
| 5,568,448 | | 10/1996 | Tanigushi et al. | 367/82 |
| 5,675,325 | | 10/1997 | Taniguchi et al. | 340/854.4 |
| 5,703,836 | | 12/1997 | Drumheller | 367/165 |
| 5,815,035 | | 9/1998 | Yamagishi et al. | 329/311 |

* cited by examiner

ACOUSTIC WAVE TRANSMISSION SYSTEM AND METHOD FOR TRANSMITTING AN ACOUSTIC WAVE TO A DRILLING METAL TUBULAR MEMBER

BACKGROUND OF THE INVENTION

1. Field of the Invention

The present invention relates to an acoustic wave transmission system and a method for transmitting an acoustic wave to a drilling metal tubular member, for use in a measurement-while-drilling (MWD) system that can transmit information on a bed or stratum and the condition of drilling equipment while drilling, capable of generating an acoustic wave (or elastic wave) having an amplitude large enough for transmission and a frequency suitable for transmission with a small amount of electric power.

2. Description of the Prior Art

Recent years have seen measurement-while-drilling (MWD) systems that can transmit information on a bed or stratum and the condition of drilling equipment while drilling, by using an acoustic wave propagating through a drill string including a plurality of drilling metal tubular members coupled to one another, such as drill collars and a drill pipe, the MWD systems being intended for reducing the drilling cost and improving the on-the-job safety. There are two types of available MWD systems: mud-pulse systems and electromagnetic-wave systems, which are classified according to which method of transmitting information is used. However, those MWD systems are not good enough to have practical applicability because the transmission rate is limited, the reliability of drilling equipment is decreased, or use environments in which prior art MWD systems can be applied are limited.

MWD techniques for transmitting information using an acoustic wave have captured the spotlight in order to solve the above-mentioned problem. Such MWD techniques can utilize a metal tubular member used for drilling as a medium through which an acoustic wave propagates. Sonic vibration transmission systems using a piezo-electric ceramic as a sonic transmitter have been proposed as one of such MWD techniques. One of such sonic vibration transmission systems is disclosed in, for example, European Pat. Publication No. 0 552 833 A1.

Referring now to FIG. 14, there is illustrated a side view of a prior art acoustic wave transmission system for transmitting an acoustic wave to a drilling metal tubular member, as disclosed in for example Japanese Patent Application Publication (KOKAI) No. 7-294658. FIG. 15 is an exploded perspective view of an oscillator for use in the acoustic wave transmission system, and FIG. 16 is a cross-sectional view of the oscillator of FIG. 15, which is mounted in the acoustic wave transmission system. In the figures, reference numeral 13 denotes a drill collar, 14 denotes a drill pipe, 301 denotes an oscillator for generating an acoustic wave by means of a number of piezo-electric ceramic crystals, 302 denotes a receiver sub, 303 denotes a receiving transducer, 304 denotes an MWD tool, 311 denotes a vibrator comprised of the number of piezo-electric ceramic crystals that are stacked side by side, 312 denotes a coupling block for coupling a metal tubular member with the oscillator 301, and 321 denotes an elastic member such as a plurality of springs. The oscillator 301 is mounted in a recess formed in the drill collar 13. The elastic member 321 forces the body of the oscillator 301 upward in such a manner that the front surface of the coupling block 312 remains engaged against a transverse wall of the drill collar 13.

Referring next to FIG. 17, there is illustrated a diagram showing the waveform of a driving current supplied into the prior art oscillator as shown in FIG. 15. FIG. 18 shows a diagram of the waveform of an acoustic wave generated in the drill collar. An acoustic wave generated by the oscillator 301 enters the drill collar 13 and then propagates upwardly. In the example of FIG. 14, the receiving transducer 303 located above the receiver sub 302 located in the middle of the drill string can receive the acoustic wave. The information can be further transmitted toward the ground through the MWD tool 304 using a prior art MWD method such as the mud-pulse method. In this manner, the acoustic wave generated by the oscillator 301 can be transmitted into the drill collar 13.

When a piezoelectric element is placed in an electric field, it undergoes a strain or distortion the amount of which depends on the magnitude of the electric field. Thus, the application of a voltage across the electrodes sandwiching a piezoelectric element causes a distortion in the piezoelectric element, the amount of distortion corresponding to the voltage. The oscillator 311 mentioned above utilizes this principle. In the oscillator 311, the plurality of piezo-electric elements are stacked side by side and separated by thin electrodes so that a voltage can be applied to each of the plurality of piezo-electric ceramic crystals. A voltage applied to across leads connected to the plurality of thin electrodes produces a driving current 331, as shown in FIG. 17, between any two adjacent electrodes and hence an electric field in each of the plurality of piezo-electric ceramic crystals. The oscillator 311 thus creates sonic vibrations, i.e. an acoustic wave 332 having a frequency corresponding to the frequency of the electric field generated in each of the plurality of piezo-electric ceramic crystals. If the alternating driving current 331 has a frequency equal to a resonance frequency of the oscillator 311, the oscillator 311 vibrates readily at the resonance frequency. The oscillator 311 can thus generate sonic vibrations having large amplitudes, so that the generated acoustic wave 332 can propagate through the drilling string comprised of the plurality of metal tubular members including the drill collar 13 and the drill pipe 14.

Prior art acoustic wave transmission systems for transmitting an acoustic wave into a metal tubular member, which are so constructed as to generate an acoustic wave using an electrostriction effect of each piezo-electric element, have following problems. One problem is that the mechanical strength of each piezo-electric element is relatively low compared with those of metal materials used in the drilling equipment, and there is therefore apprehension that each piezo-electric element becomes damaged because of the impact of drilling and its own electrostriction. Another problem is that since it is difficult to impose an adequate amount of load on the oscillator when mounting it in the drill collar 13, the efficiency of transmitting an acoustic wave generated by the oscillator into a metal tubular member cannot be improved.

A further problem is that because the Curie temperature of a piezo-electric ceramic crystal is about 120° C., for example, and therefore it does not get distorted if its temperature exceeds the Curie temperature, such a piezo-electric ceramic crystal cannot be used in high-temperature environments such as the bottom of a well bore. In addition, the length of the stack of the plurality of piezo-electric elements must be 1 m or more to create sonic vibrations of a low frequency required for transmitting information through a plurality of metal tubular members because the frequency of sonic vibrations is determined according to the thickness of each piezo-electric element. Accordingly, a large amount of energy is needed to drive a large stack of piezo-electric elements, and it is therefore difficult to provide a power supply suitable for supplying adequate power to such a large piezo-electric vibrator intended for systems for transmitting information about the bottom of a borehole. Further, it is therefore difficult to provide a small piezo-electric vibrator suitable for systems for transmitting information about the bottom of a borehole.

SUMMARY OF THE INVENTION

The present invention is made to overcome the above problems. It is therefore an object of the present invention to provide an acoustic wave transmission system and a method for transmitting an acoustic wave into a drilling metal tubular member, for use in an MWD system, capable of generating an acoustic wave having an amplitude large enough for transmission and a frequency suitable for transmission with a small amount of electric power, by using a vibrator (or oscillator) made of a magnetostrictive material, which can withstand vibrations generated by drilling and exposure to high temperature in the vicinity of the bottom of a well bore.

In accordance with one aspect of the present invention, there is provided an acoustic wave transmission system for generating and transmitting an acoustic wave into a metal member of a drill string, comprising: an acoustic wave generating metal tubular member for converting information about the bottom of a borehole, which is obtained by a bottom hole sensor, into an acoustic wave, and for furnishing the acoustic wave; a receiving metal tubular member for receiving the acoustic wave from the acoustic wave generating metal tubular member by way of the drill string; a demodulator for demodulating the acoustic wave received by the receiving metal tubular member so as to extract the information about the bottom of the borehole; the acoustic wave generating metal tubular member including acoustic wave generating mechanism having at least a magnetostrictive oscillator which is mounted in a recess formed in an outer wall of the acoustic wave generating metal tubular member, and on which a compressive load is imposed by means of a pre-load mechanism using a vise, the magnetostrictive oscillator being constructed of a stack of thin plates each made of a metal magnetostrictive material having a property of increasing its dimensions when magnetized, the thin plates being bonded together by a heat-resistant adhesive, and the magnetostrictive oscillator thus having a buckling strength large enough to resist the compressive load imposed thereon by the pre-load mechanism and a stress due to a strain caused in itself; and the acoustic wave generating metal tubular member further including excitation current supplying unit for supplying either a rectangular, sinusoidal, or triangular alternating excitation current modulated with the information about the bottom of the borehole and having a frequency that is half a carrier frequency of the acoustic wave, or a series of excitation pulses modulated with the information about the bottom of the borehole and having a pulse repetition rate that is equal to the carrier frequency of the acoustic wave, to an excitation winding wound around the magnetostrictive oscillator, so as to cause the magnetostrictive oscillator to generate and transmit an acoustic wave having an arbitrary frequency into the acoustic wave generating metal tubular member.

Preferably, a drill collar can serve as the acoustic wave generating metal tubular member.

In accordance with a preferred embodiment of the present invention, the acoustic wave generating mechanism includes a resonance capacitor connected in series or parallel to the excitation winding wound around the magnetostrictive oscillator, the resonance capacitor having a capacitance which is predetermined such that a resonance frequency defined by the inductance of the excitation winding and the capacitance of the resonance capacitor is half the carrier frequency of the acoustic wave.

In accordance with another preferred embodiment of the present invention, the acoustic wave generating mechanism includes a plurality of magnetostrictive oscillators which are mounted in respective recesses formed in the outer wall of the acoustic wave generating metal tubular member and on which compressive loads are imposed respectively by means of the pre-load mechanism using a plurality of vises. Preferably, the acoustic wave generating mechanism includes a resonance capacitor connected in series or parallel to a plurality of excitation windings in series or in parallel, which are respectively wound around the plurality of magnetostrictive oscillators, the resonance capacitor having a capacitance which is predetermined such that a resonance frequency defined by the total inductance of the plurality of excitation windings and the capacitance of the resonance capacitor is half the carrier frequency of the acoustic wave.

In accordance with another preferred embodiment of the present invention, the excitation current supplying unit supplies an excitation current that is large enough to cause the magnetostrictive oscillator to be magnetized to saturation.

In accordance with another aspect of the present invention, there is provided a method of generating and transmitting an acoustic wave into a metal member of a drill string, including the steps of converting information about the bottom of a borehole, which is obtained by a bottom hole sensor, into an acoustic wave, receiving the acoustic wave by way of the drill string at the ground, and demodulating the acoustic wave received so as to extract the information about the bottom of the borehole; the method further comprising the steps of: providing at least a magnetostrictive oscillator, which is mounted in a recess formed in an outer wall of a metal member of the drill string, while imposing a compressive load on the magnetostrictive oscillator mounted in the recess by means of a pre-load mechanism using a vise, the magnetostrictive oscillator being constructed of a stack of thin plates each made of a metal magnetostrictive material having a property of increasing its dimensions when magnetized, the thin plates being bonded together by a heat-resistant adhesive, and the magnetostrictive oscillator thus having a buckling strength large enough to resist the compressive load imposed thereon by the pre-load mechanism and a stress due to a strain caused in itself; and supplying either a rectangular, sinusoidal, or triangular alternating excitation current modulated with the information about the bottom of the borehole and having a frequency that is half a carrier frequency of the acoustic wave, or a series of excitation pulses modulated with the information about the bottom of the borehole and having a pulse repetition rate that is equal to the carrier frequency of the acoustic wave, to an excitation winding wound around the magnetostrictive oscillator, so as to cause the magnetostrictive oscillator to generate and transmit an acoustic wave having an arbitrary frequency into the metal member of the drill string.

Further objects and advantages of the present invention will be apparent from the following description of the preferred embodiments of the invention as illustrated in the accompanying drawings.

BRIEF DESCRIPTION OF THE DRAWINGS

FIG. 4(*b*) is a cross-sectional view taken along the line A–A' of FIG. 4(*a*);

FIG. 7(*b*) is a cross-sectional view taken along the line A–A' of FIG. 7(*a*);

FIG. 12(*b*) is a diagram showing the waveforms of the magnetic flux density applied to the magnetostrictive oscillator for use in the acoustic wave transmission apparatus according to the fifth embodiment of the present invention, and the magnetic field caused by the excitation winding or the current flowing through the excitation winding when the amplitude of the magnetic flux density reaches the nonlinear range of the magnetic saturation curve as shown in FIG. 12(*b*);

DETAILED DESCRIPTION OF THE PREFERRED EMBODIMENTS

First Embodiment

Figure 1:
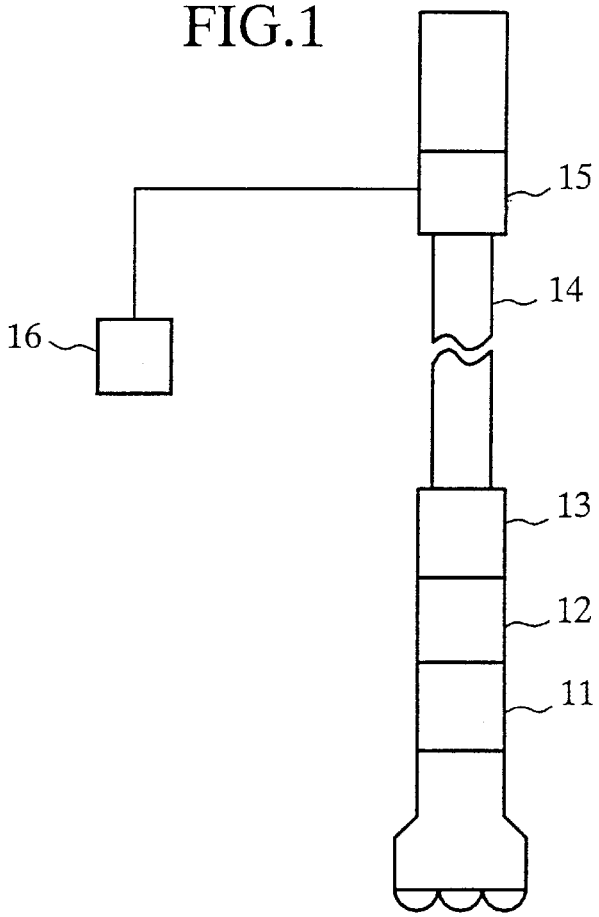
FIG. 1 is a block diagram showing the structure of an MWD system that is so constructed as to use an acoustic wave transmission apparatus for transmitting an acoustic wave into a metal tubular member of a drill string, according to a first embodiment of the present invention.
Figure 2:
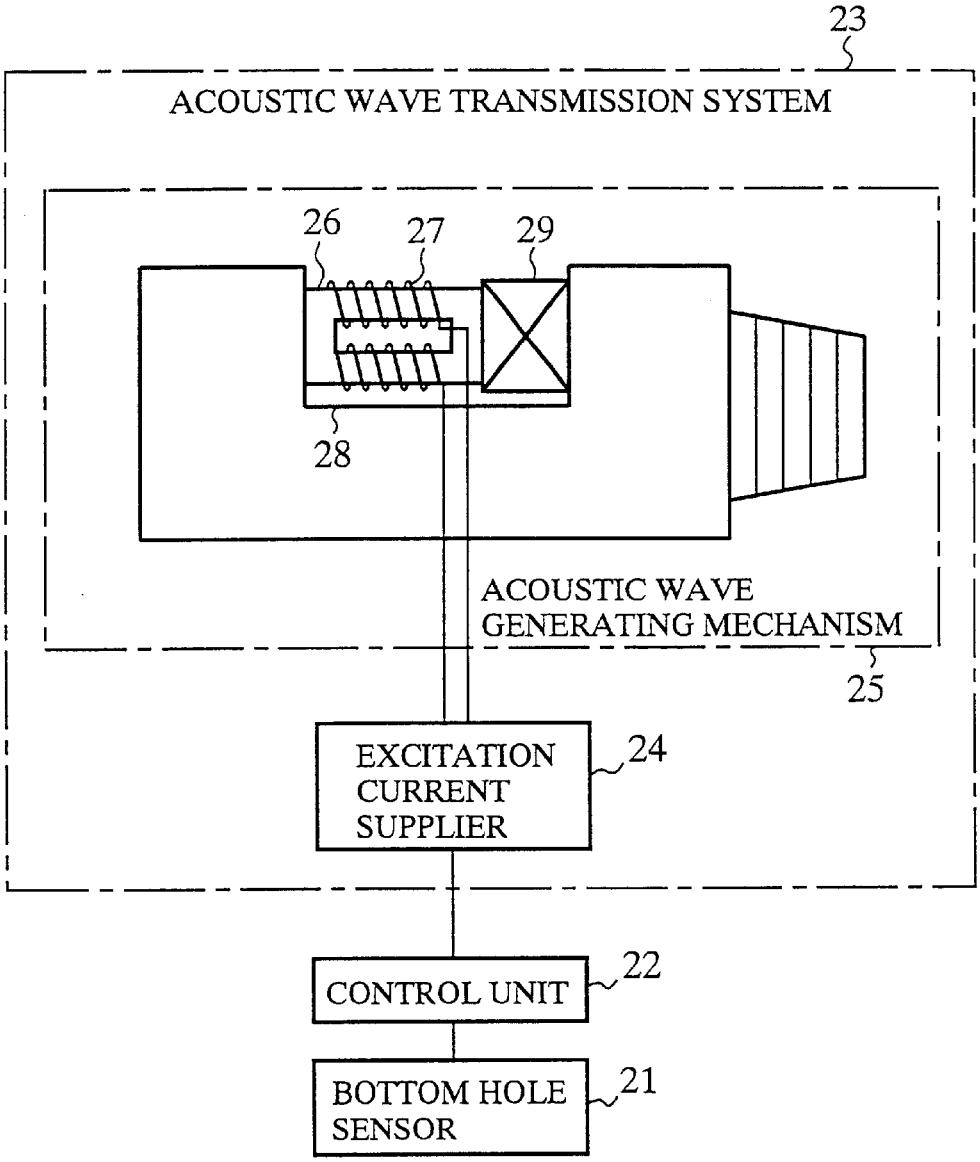
FIG. 2 is a diagram showing the structure of the acoustic wave transmission apparatus of the first embodiment of the present invention.

Referring next to FIG. 1, there is illustrated a block diagram showing the structure of an MWD system that is so constructed as to use an acoustic wave transmission system for transmitting an acoustic wave into a metal tubular member of a drill string, according to a first embodiment of the present invention. FIG. 2 shows the structure of the acoustic wave transmission system according to the first embodiment of the present invention. In FIG. 1, reference numeral 11 denotes a sensor metal tubular member disposed on a drill bit, for containing a bottom hole sensor, 12 denotes an acoustic wave (elastic wave) generating metal tubular member for converting information on the bottom of a borehole, which is obtained by the sensor metal tubular member 11, into an elastic wave to be transmitted through at least a drill collar 13 and a drill pipe 14, 15 denotes a receiver metal tubular member located at the ground level, for receiving the acoustic wave transmitted thereto from the acoustic wave generating metal tubular member 12 by way of at least the drill collar 13 and the drill pipe 14, and 16 denotes a demodulator for demodulating the elastic wave received by the receiver metal tubular member 15 so as to extract the information on the bottom of the borehole. Preferably, a drill collar can be machined so that it serves as the acoustic wave generating metal tubular member 12.

In FIG. 2, reference numeral 21 denotes the bottom hole sensor contained in the bottom hole sensor metal tubular member 11, for measuring drilling information such as one on the stratum or bed at the bottom of the borehole, drilling conditions, and the bearing, and 22 denotes a control unit for converting the drilling information obtained by the bottom hole sensor 21 into a binary code and for furnishing it. The acoustic wave transmission apparatus 23 is provided with an excitation current supplier 24 and an acoustic wave generating mechanism 25. The acoustic wave transmission system 23 can generate an acoustic wave including the drilling information into at least the drill collar 13 and the drill pipe 14. The excitation current supplier 24 can supply an excitation current to the acoustic wave generating mechanism 25 according to the modulated binary signal from the control unit 22. The acoustic wave generating mechanism 25 includes a maqnetostrictive oscillator 26 mounted in a recess 28 formed in the outer wall of the acoustic wave generating metal tubular member 12 and pressed by means of a pre-load mechanism using a vice 29. An exciting winding 27 is wound around the magnetostrictive oscillator 26 mounted in the recess 28.

Figure 3:
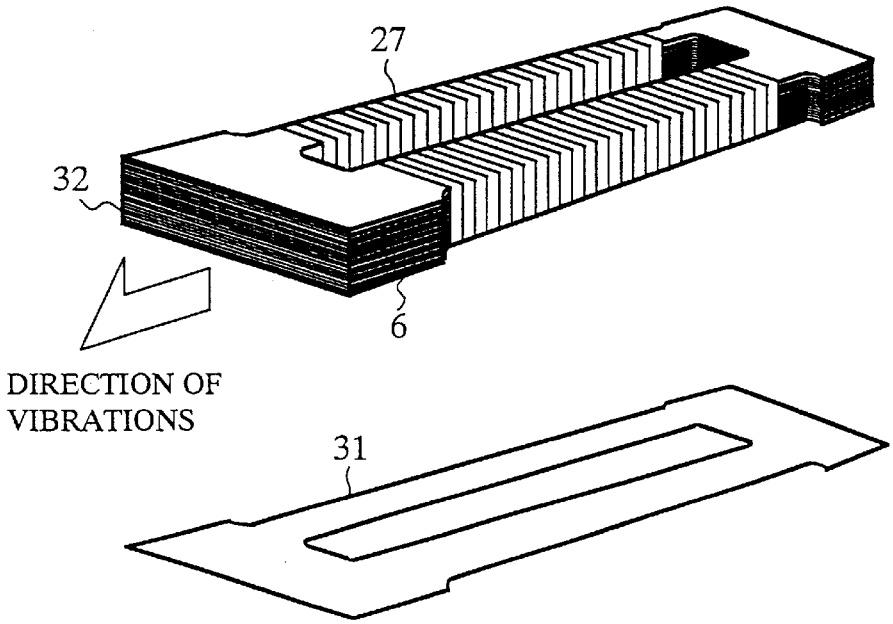
FIG. 3 is a perspective diagram showing the shape of a magnetostrictive oscillator of the acoustic wave transmission apparatus of the first embodiment of the present invention.

Referring next to FIG. 3, there is illustrated a perspective diagram showing the shape of the magnetostrictive oscillator 26 of the acoustic wave transmission system of the first embodiment of the present invention. In the figure, reference numeral 31 denotes a magnetostrictive element formed like a thin plate, the magnetostrictive oscillator 26 being constructed of a plurality of laminated magnetostrictive elements 31 for reducing the eddy-current loss due to the excitation, and 32 denotes a vibration surface via which sonic vibrations generated are transmitted into the metal tubular member. In order to cause the magnetostrictive oscillator 26 to create sonic vibrations, the exciting winding 27 is wound in a direction orthogonal to the direction of the strain or magnetostriction to be caused in the magnetostrictive material. When a certain amount of current is supplied to the exciting winding 27, a magnetic field occurs in the same direction as the distortion to be caused, thereby causing the magnetostriction phenomenon. In the case that the magnetostrictive oscillator 26 is so constructed, the direction in which the plurality of magnetostrictive elements 31 are laminated is orthogonal to the direction of sonic vibrations created, and the plurality of magnetostrictive elements 31 expand and contract such that the phases of their movements are synchronized with one another and the amplitudes of their movements are the same as one another. Accordingly, no stress enough to delaminate the plurality of magnetostrictive elements 31 stacked is applied to the magnetostrictive oscillator 26. The magnetostrictive oscillator 26 of the present invention can thus have an adequate strength as excitation equipment.

In addition, since the compressive load is imposed on the magnetostrictive oscillator 26 mounted in the recess, there is a good contact between the vibration surface 32 of the magnetostrictive oscillator and the acoustic wave generating metal tubular member 12 and the transmission efficiency of the acoustic wave is therefore improved. Further, when the magnetostrictive oscillator 26 is made of a magnetostrictive material having a positive property of increasing its dimensions when it is magnetized, such as cobalt, a displacement and a detachment of the magnetostrictive oscillator 26 due to the excitation can be prevented. The stress applied the magnetostrictive oscillator 26 from outside can improve the magnetostriction characteristic of the oscillator 26. It is known that the amount of strain caused when a magnetic field of the same magnitude is applied to the magnetostrictive oscillator increases with the application of mechanical stress from outside. Therefore, the efficiency of conversion of power to the acoustic wave is improved. However, the sum of the compressive stress applied to the magnetostrictive oscillator 26 by means of the pre-load mechanism and the magnetostrictive stress caused by the excitation has to be less than the buckling strength of the magnetostrictive oscillator 26.

Figure 16:
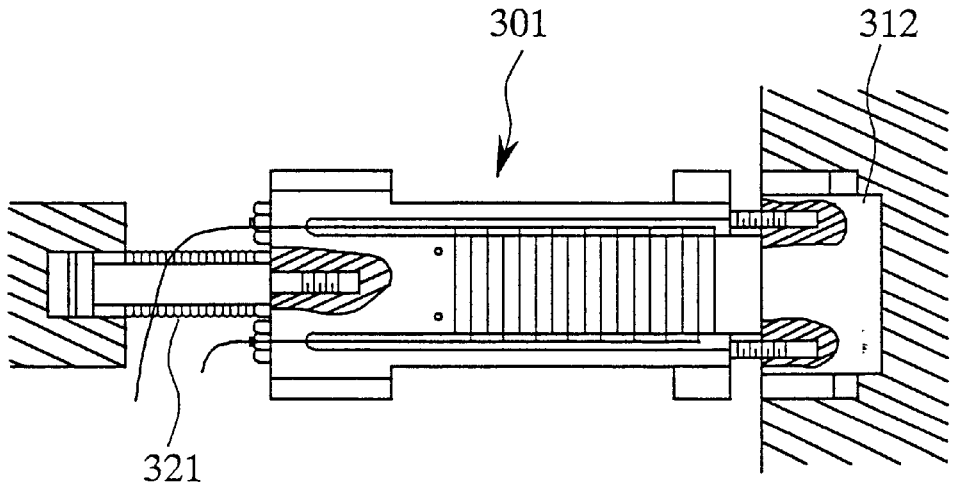
FIG.16 (PRIOR ART)
FIG. 16 is a cross-sectional view of the oscillator of FIG. 15, which is mounted in the acoustic wave transmission system of FIG. 14.
Figure 17:
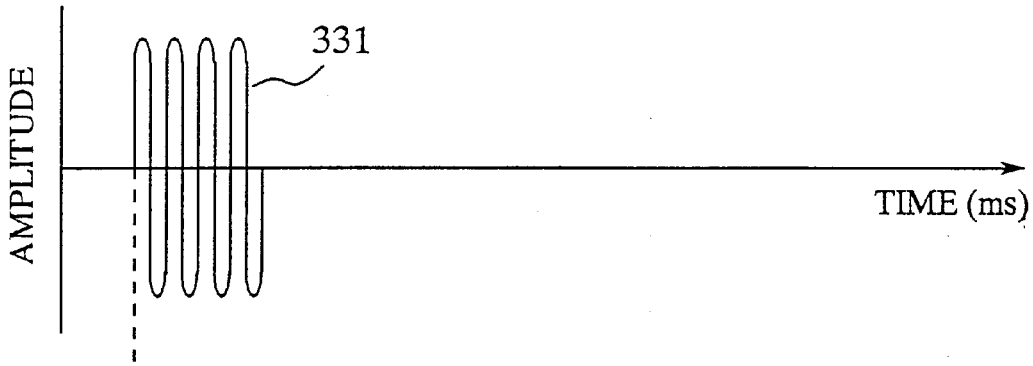
FIG.17 (PRIOR ART)
FIG. 17 is a diagram showing the waveform of a driving current supplied into the prior art oscillator as shown in FIG. 15.
Figure 18:
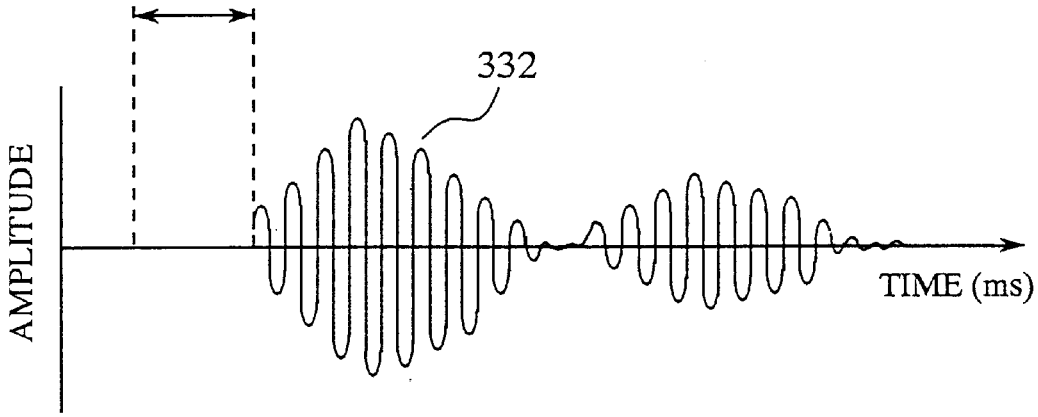
FIG.18 (PRIOR ART)
FIG. 18 is a diagram of the waveform of an acoustic wave generated in a drill collar by the prior art oscillator as shown in FIG. 15.

It is known that when a tension load is imposed on a magnetostrictive material having a negative property of reducing its dimensions when excited, such as nickel, the amount of strain or distortion increases with the application of a magnetic field of the same magnitude, as disclosed in Yoshimitsu Kikuchi, "Magnetostrictive Vibration and Ultrasonic Wave", Corona Publishing Co., Ltd., pp. 158–160, Jan. 20, 1952. In such a magnetostrictive material on which a tension load is imposed, since a larger amount of distortion can occur with the same amount of excitation current, the amplitude of sonic vibrations generated is increased and the efficiency of occurrence of vibrations is therefore improved. In the case that the magnetostrictive oscillator is made of nickel, the tension load of 10.4 kg/mm$^2$ is needed to achieve maximum efficiency of occurrence of vibrations. In contrast, when the magnetostrictive oscillator 26 is made of a magnetostrictive material having a positive property of increasing its dimensions when excited, a compressive load of a few tons per square millimeter has to be applied to the magnetostrictive oscillator in order to obtain maximum efficiency of occurrence of vibrations. Although it is difficult to impose such a large compressive load on the conventional elastic member 321 as shown in FIG. 16, it is possible to apply such a large compressive load to the magnetostrictive oscillator 26 in the acoustic wave generating mechanism 25 by means of the vice 29.

The ambient temperature in the vicinity of the bottom of the borehole where the acoustic wave transmission apparatus 23 is located can reach 175° C., and the pressure at the bottom of the borehole can reach 20,000 psi. The magnetostrictive oscillator 26 has to be so constructed as to operate with stability in such an environment. The mechanical strength of the magnetostrictive oscillator 26 should be taken into consideration in order to determine the structure of the bottom hole equipment on which a load of up to 10 tons is imposed while drilling. A magnetostrictive metal material having a large strength and a high Curie point can be chosen so as to make the magnetostrictive oscillator 26 be capable of resisting such a high-temperature and high-pressure drilling environment.

Figure 4:
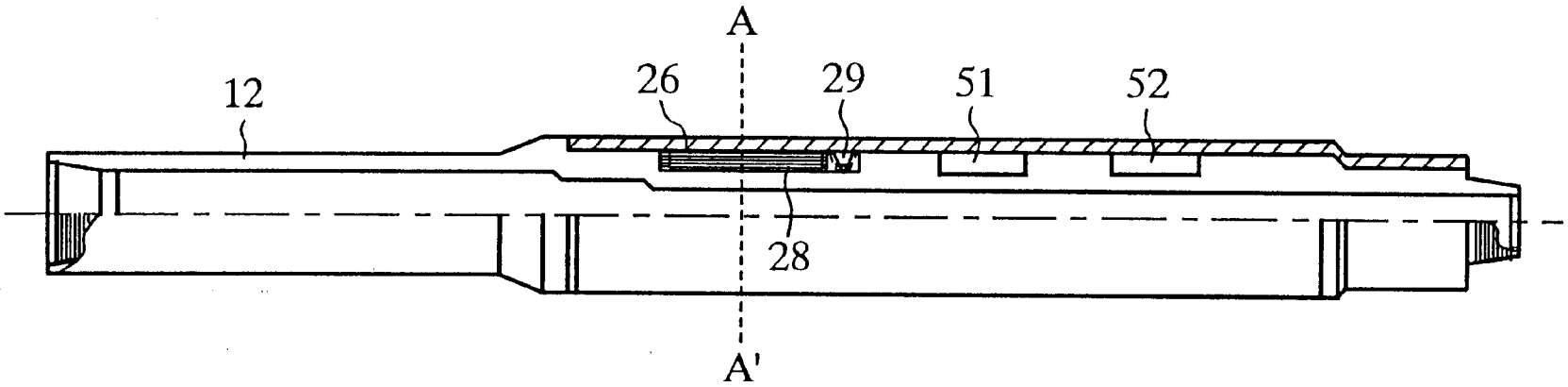
FIG. 4(*a*) is a longitudinal cross-sectional view of an acoustic wave generating metal tubular member in which the magnetostrictive oscillator of FIG. 3 is mounted.
Figure 4:
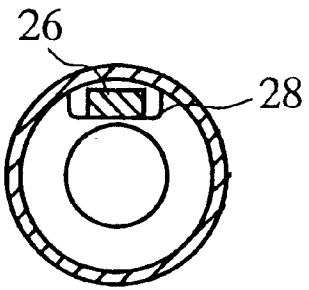
Figure 5:
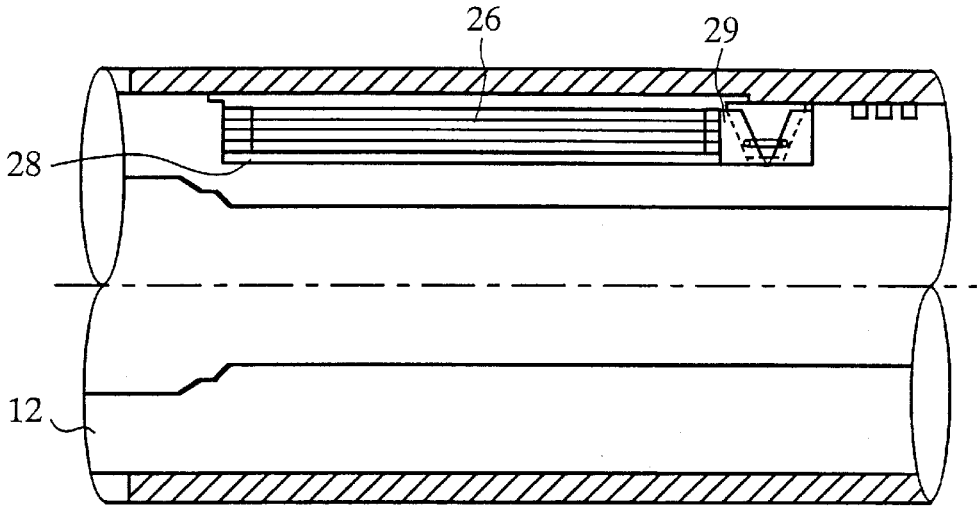
FIG. 5 is a longitudinal cross-sectional view of an enlarged part of the acoustic wave generating metal tubular member of FIG. 4(*a*) including the magnetostrictive oscillator.

Referring next to FIG. 4(*a*), there is illustrated a longitudinal cross-sectional view of the acoustic wave generating metal tubular member, in which the magnetostrictive oscillator is mounted, of the acoustic wave transmission system according to the first embodiment of the present invention. FIG. 4(*b*) is a cross-sectional view taken along the line A–A' of FIG. 4(*a*). FIG. 5 is a longitudinal cross-sectional view of an enlarged part of the acoustic wave generating metal tubular member of FIG. 4(*a*) including the magnetostrictive oscillator 26. As shown in those figures, the acoustic wave generating mechanism 25 of FIG. 2 is applied to the acoustic wave generating metal tubular member 12. For example, in the outer wall of the acoustic wave generating metal tubular member 12 that can be a drill collar, a first recess 28 for mounting the magnetostrictive oscillator 26, a second recess 51 for mounting the control unit 22, and a third recess 52 for mounting the excitation current supplier 24 are formed. Thus, an acoustic wave transmitter intended for uses at the bottom of a well bore made for oil drilling or natural gas drilling can be provided.

As previously mentioned, FIGS. 4(*a*) and 4(*b*) show an example of the acoustic wave generating metal tubular member 12 intended for an acoustic wave transmitter that can be placed at the bottom of a borehole. However, when constructing an acoustic wave transmitter intended for uses at the ground level using the acoustic wave generating mechanism 25 of FIG. 2, there is no need to mount the control unit 22 and the excitation current supplier 24 in the acoustic wave generating metal tubular member 12 such as a drill collar.

Figure 6:
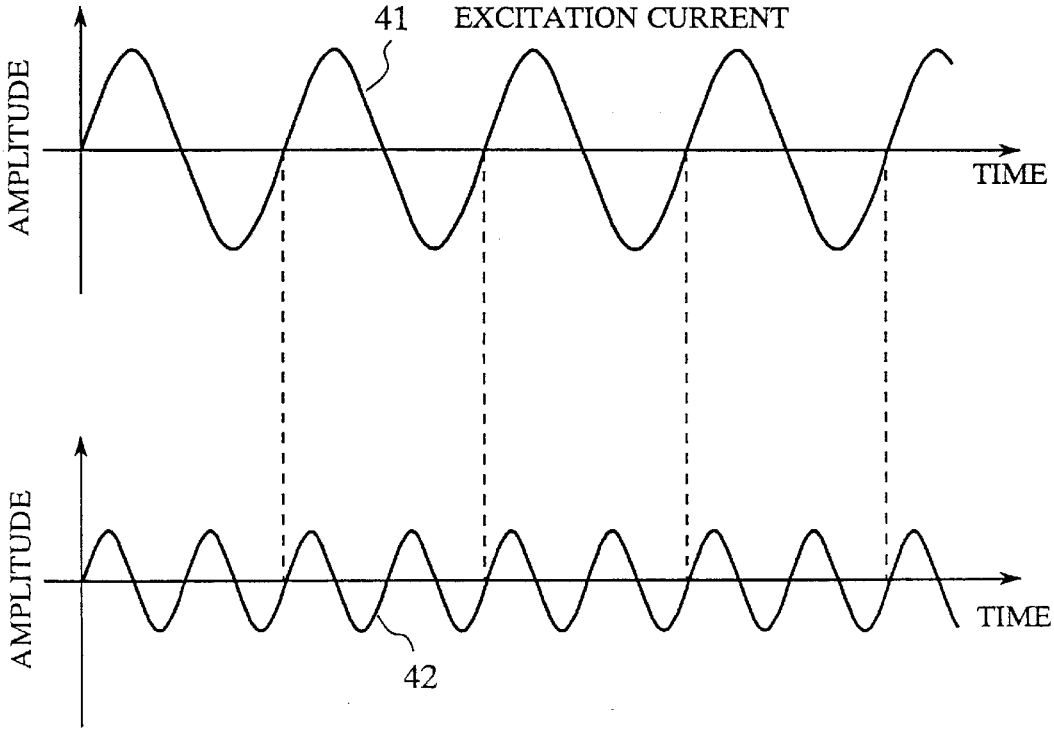
FIG. 6 is a diagram showing the waveforms of excitation current generated and vibrations caused by the magnetostrictive oscillator mounted in the acoustic wave transmission apparatus of the first embodiment of the present invention.

Referring next to FIG. 6, there is illustrated a diagram showing the waveforms of an excitation current supplied to the excitation winding and vibrations caused by the magnetostrictive oscillator mounted in the acoustic wave transmission apparatus of the first embodiment of the present invention. In the figure, reference numeral 41 denotes the waveform of the excitation current, and 42 denotes the waveform of the acoustic wave generated by the magnetostrictive oscillator. When the bottom hole sensor 21 mounted in the bottom hole sensor metal tubular member 11 obtains information on drilling, the control unit 22 mounted in the acoustic wave generating metal tubular member 12 modulates a carrier signal with the drilling information and then furnishes it to the acoustic wave transmission apparatus 23. The acoustic wave transmission apparatus 23 then creates and transmits an acoustic wave including the drilling information into the metal tubular member 12 of the drill string including at least the drill collar 13 and the drill pipe 14 other than the metal tubular member 12. The receiver metal tubular member 15 located at the ground level receives the acoustic wave transmitted thereto, and the demodulator 16 then demodulates the modulated signal from the receiver metal tubular member 15 so as to extract the drilling information.

The excitation current supplier 24 supplies the excitation current 41 to the excitation winding 27 which is wound around the magnetostrictive oscillator 26 disposed in the acoustic wave generating mechanism 25, the excitation current, 41 having an amplitude according to the modulated signal from the control unit 22. When the excitation current 41 is applied to the excitation winding 27, the magnetostrictive oscillator 26 generates an acoustic wave. As previously mentioned, the magnetostrictive oscillator 26 utilizes a phenomenon in which distortion occurs in the magnetostrictive material when it is placed in a magnetic field and the distortion has a certain amount corresponding to the magnitude of the magnetic field, so as to generate an acoustic wave according to the magnetic field. The amount of distortion caused in the magnetostrictive oscillator 26 due to the magnetostriction phenomenon is proportional to the amount of the excitation current 41. Further, the response time of the magnetostriction oscillator is about tens of microseconds or less and is adequately fast as compared with the required transmission speed of the drilling information. Accordingly, the application of the excitation current 41 whose frequency, phase, or amplitude is varied according to the modulated signal from the control unit 22 makes it possible for the magnetostrictive oscillator 26 to generate an acoustic wave having a waveform corresponding to the drilling information. Thereby, the drilling information can be transmitted to the receiver through the acoustic wave generated by the magnetostrictive oscillator 26.

The control unit 22 can convert the drilling information obtained by the bottom hole sensor 21 into a binary code. The control unit 22 then modulates a carrier wave with the binary code by using, for example, amplitude-shift keying or ASK. The excitation current supplier 24 then generates an excitation current whose amplitude is varied with time according to the modulated signal from the control unit 22. When the excitation current flows through the excitation winding 27, the magnetostrictive oscillator 26 then creates and transmits an acoustic wave modulated with the drilling information into the metal tubular member 12 of the drill string further including at least the drill collar 13 and the drill pipe 14. The receiver located at the ground level can thus receive and demodulate the acoustic wave transmitted thereto so as to extract the drilling information about the bottom of the borehole.

The magnetostrictive characteristic varies among magnetostrictive materials. For example, in the case of cobalt, it can become distorted in a direction in which it can expand at all times regardless of the polarity of a magnetic field excited and applied thereto. When an excitation current 41 having a rectangular, triangular, or sinusoidal waveform, but not DC biased, is applied to the excitation winding 27 so as to excite the magnetostrictive oscillator 26, the magnetostrictive material becomes distorted every time the polarity of the magnetic field generated by the excitation winding 27 varies. This results in generating acoustic wave vibrations having a waveform 42 and a certain frequency twice as long as that of the excitation current 41. Consequently, when an alternating voltage having a certain frequency $f_d$ that is half of a carrier frequency $f_c$ is applied to the excitation winding 27 of the magnetostrictive oscillator 26 mounted in the acoustic wave generating mechanism 25, an acoustic wave having a large amplitude can be generated and transmitted into the metal tubular member 12 of the drill string further including at least the drill collar 13 and the drill pipe 14 with a high degree of efficiency. This results in making it possible to transmit drilling information from an ultra-deep stratum (or bed). The relationship between $f_c$ and $f_d$ is given by the following equation (1):

$$f_c=2f_d \tag{1}$$

As an alternative, the excitation current 41 can be comprised of a series of pulses of one polarity so as to excite and cause the magnetostrictive oscillator 26 to generate vibrations 42 of an acoustic wave. In this case, the polarity of the excited magnetic field is not inverted and the magnetostrictive oscillator 26 becomes distorted in the synchronization with the series of excitation current pulses. Accordingly, in this case, the pulse repetition rate $f_d$ of the series of excitation current pulses is set to be equal to the desired frequency $f_c$ of the vibrations 42 of the acoustic wave.

As previously mentioned, in accordance with the first embodiment of the present invention, the magnetostrictive oscillator 26 can be mounted in the recess 28 formed in the acoustic wave generating metal tubular member 12 such as a drill collar with a compressive load imposed on the magnetostrictive oscillator 26 mounted in the recess 28 by means of the pre-load mechanism using the vice 29. Accordingly, the first embodiment offers the advantage of being able to make an acoustic wave generated by the magnetostrictive oscillator 26 transmit into the acoustic wave generating metal tubular member 12 with a high degree of efficiency.

Second Embodiment

Figure 7:
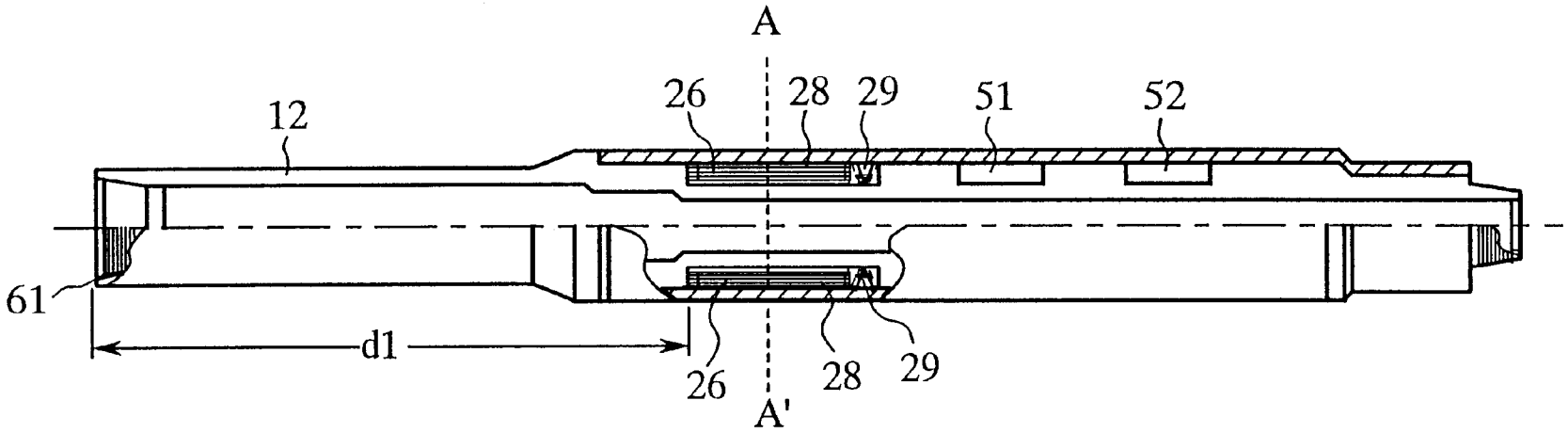
FIG. 7(*a*) is a longitudinal cross-sectional view of an acoustic wave generating metal tubular member, in which two magnetostrictive oscillators is mounted, of an acoustic wave transmission apparatus according to a second embodiment of the present invention.
Figure 7:
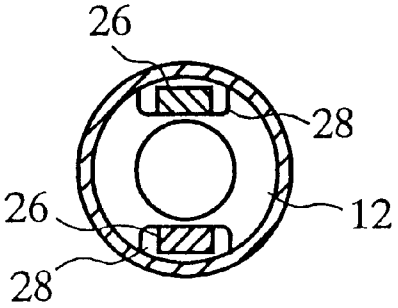
Figure 8:
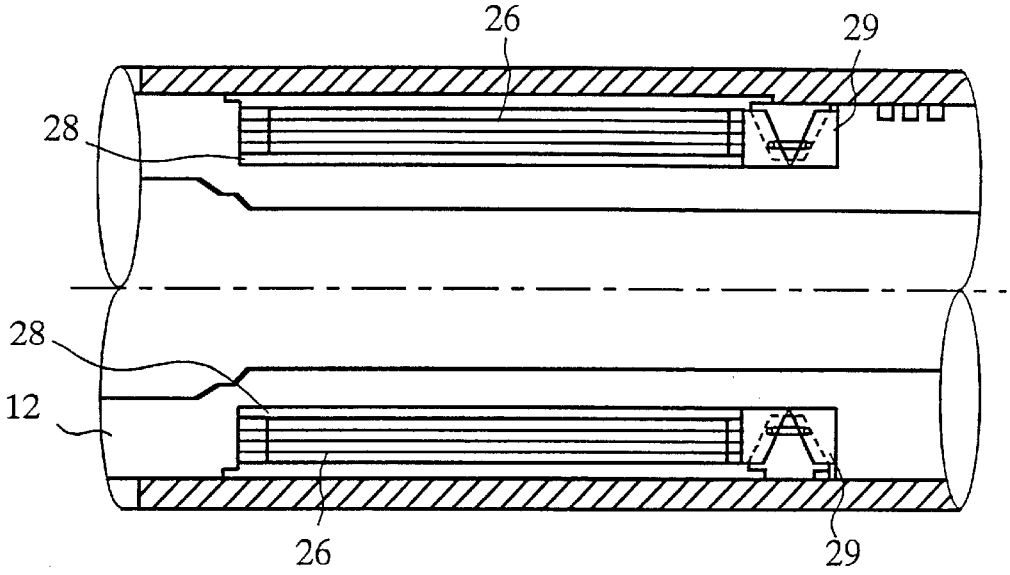
FIG. 8 is a longitudinal cross-sectional view of an enlarged part of the acoustic wave generating metal tubular member of FIG. 7(*a*) including the two magnetostrictive oscillators.

Referring next to FIG. 7(*a*), there is illustrated a longitudinal cross-sectional view of an acoustic wave generating metal tubular member, in which two magnetostrictive oscillators are mounted, for use in an acoustic wave transmission system according to a second embodiment of the present invention. FIG. 7(*b*) is a cross-sectional view taken along the line A–A' of FIG. 7(*a*). FIG. 8 is a longitudinal cross-sectional view of an enlarged part of the acoustic wave generating metal tubular member of FIG. 7(*a*) including the two magnetostrictive oscillators. In those figures, the same reference numerals as shown in FIGS. 4(*a*), 4(*b*), and 5 designate the same elements as those of the acoustic wave transmission apparatus of the above-mentioned first embodiment or like elements, and therefore the description of those elements will be omitted hereinafter. In FIG. 7(*a*), reference numeral 61 denotes one end surface of the acoustic wave generating metal tubular member 12.

The plurality of magnetostrictive oscillators 26, in the case of FIG. 7(*a*) the two magnetostrictive oscillators 26, can be mounted in respective recesses 28 for mounting magnetostrictive oscillators, which are formed in the acoustic wave generating metal tubular member 12 at a certain distance from the end surface 61 of the acoustic wave generating metal tubular member 12, while they are pressed and fixed by a pre-load mechanism using two vices 29, as shown in FIG. 7(*a*). The plurality of excitation windings 27 respectively wound around the plurality of magnetostrictive oscillators 26 mounted in the respective recesses 28 can be connected in series or in parallel with one another. An excitation current supplier 24 supplies an excitation current into the plurality of excitation windings 27. The plurality of magnetostrictive oscillators 26 can oscillate in synchronization with one another, and create and transmit acoustic waves into the acoustic wave generating metal tubular member 12. The acoustic waves generated by the plurality of magnetostrictive oscillators 26 can be in phase with one another with respect to the longitudinal direction of the acoustic wave generating metal tubular member 12. Thus, they do not balance each other out, and the amplitude of the combined acoustic waves is therefore twice as large as that of each of the two acoustic waves generated by the two magnetostrictive oscillators 26. It can be safely said that the amplitude of each of the acoustic waves generated by the two magnetostrictive oscillators 26 is multiplied by two (or amplified).

If each of the plurality of recesses 28 for mounting the plurality of magnetostrictive oscillators 26 is at a certain distance d1 from the end surface 61, which is n-times (n: integer) as large as the wavelength λ of the carrier wave, the plurality of acoustic waves generated by the plurality of magnetostrictive oscillators 26 would be in phase with one another with respect to the longitudinal direction of the acoustic wave generating metal tubular member 12. In this case, they do not balance each other out, and therefore the amplitude of the combined acoustic waves is not reduced. Thus, even when all of the plurality of recesses cannot be formed at the same distance from the end surface 61 from the viewpoint of the structure of the acoustic wave generating metal tubular member 12, the plurality of magnetostrictive oscillators 26 can be arranged in the acoustic wave generating metal tubular member 12 so as to multiply the amplitude of the combined acoustic waves generated in the acoustic wave generating metal tubular member 12.

As previously mentioned, in accordance with the second embodiment of the present invention, the plurality of magnetostrictive oscillators 26 can be mounted in the respective recesses 28 formed in the outer wall of the acoustic wave generating metal tubular member 12, such as a drill collar, so that the amplitude of the combined acoustic waves generated by the plurality of magnetostrictive oscillators 26 is increased while the pre-load mechanism using the plurality of vices 29 imposes a plurality of compressive loads on the plurality of magnetostrictive oscillators 26, respectively. Accordingly, the second embodiment offers the advantage of being able to generate an acoustic wave of greater amplitude and make the acoustic wave transmit into the acoustic wave generating metal tubular member 12 with a high degree of efficiency.

Third Embodiment

Figure 9:
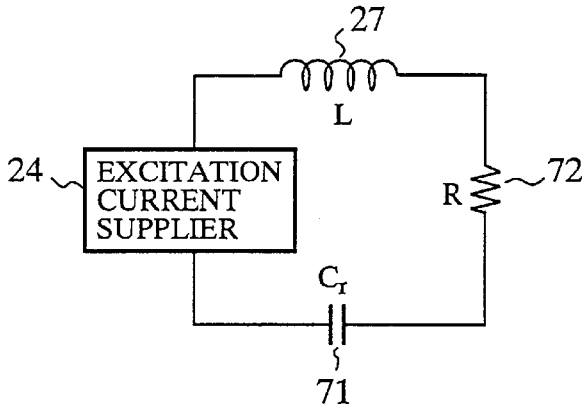
FIG. 9 is a schematic circuit diagram showing an electric resonance circuit for use in the acoustic wave generating mechanism of the acoustic wave transmission apparatus according to the above-mentioned first embodiment of the present invention.

Referring next to FIG. 9, there is illustrated a schematic circuit diagram showing an electric resonance circuit according to a third embodiment of the present invention, for use in the acoustic wave generating mechanism of the acoustic wave transmission apparatus of the above-mentioned first embodiment. In FIG. 9, the same reference numerals as shown in FIG. 2 designate the same elements as those of the acoustic wave transmission apparatus of the above-mentioned first embodiment or like elements, and therefore the description of those elements will be omitted hereinafter. As shown in FIG. 9, a resonance capacitor 71 is connected in series to an excitation winding 27 wound around a magnetostrictive oscillator 26. An internal resistance 72 is also connected in series to the excitation winding 27.

The impedance Z of the electric resonance circuit, in which the resonance capacitor 71 and the excitation winding 27 are in series, is given by the following equation (2):

$$Z=R+j(\omega L-1/\omega C) \tag{2}$$

where C is the capacitance of the resonance capacitor 71, L is the inductance of the excitation winding 27, R is the resistance of the internal resistor 72, f is the frequency of a voltage applied to the excitation winding 27, and ω is 2πf.

The resonance frequency $f_0$ of the resonance circuit is then given by the following equation (3):

$$2\pi f_0=1/\sqrt{(LC)} \tag{3}$$

In the case that f is equal to the resonance frequency $f_0$, the impedance Z of the resonance circuit is reduced to its minimum value R.

Therefore, following the next equation (4) described below, the capacitance of the resonance capacitor 71 can be set to a value Cr so that resonance occurs at a given frequency $f_d$ of the voltage applied to the excitation winding 27.

$$Cr=1/((2\pi f_d)^2\times L) \tag{4}$$

The impedance of the resonance circuit is thus reduced to its minimum value and hence a desired amount of current flows through the resonance circuit. Consequently, the acoustic wave transmission system can generate an acoustic wave of required amplitude with a smaller amount of electric power.

In a variant, the resonance capacitor 71 and the excitation winding 27 are connected in parallel to each other, instead of connecting them in series. This variant can offer the same advantage as provided by the third embodiment mentioned above.

As previously mentioned, in accordance with the third embodiment of the present invention, there is provided a resonance circuit in which the excitation winding 27 wound around the magnetostrictive oscillator 26 and the resonance capacitor 71 are connected in series or in parallel, and the impedance of the resonance circuit can be reduced to its minimum value at the resonance frequency determined by the inductance of the excitation winding 27 and the capacitance of the resonance capacitor 71. Accordingly, the third embodiment can offer the advantage of being able to generate an acoustic wave with a small amount of electric power and transmit the acoustic wave into the acoustic wave generating metal tubular member 12 with a high degree of efficiency.

Fourth Embodiment

Figure 10:
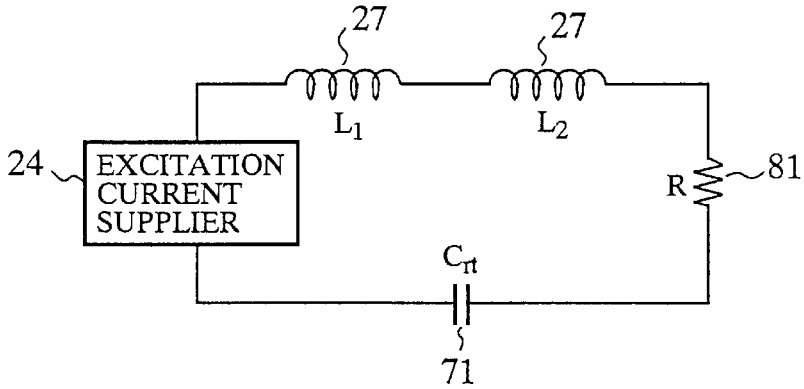
FIG. 10 is a schematic circuit diagram showing an electric resonance circuit for use in the acoustic wave generating mechanism of the acoustic wave transmission apparatus according to the above-mentioned second embodiment of the present invention.

Referring next to FIG. 10, there is illustrated a schematic circuit diagram showing an electric resonance circuit according to a fourth embodiment of the present invention, for use in the acoustic wave generating mechanism of the acoustic wave transmission apparatus of the above-mentioned second embodiment. In the figure, the same reference numerals as shown in FIG. 9 designate the same elements as those of the resonance circuit of the above-mentioned third embodiment, and therefore the description of those elements will be omitted hereinafter. As previously mentioned, in the acoustic wave transmission system of the second embodiment, a plurality of magnetostrictive oscillators 26 (in the case of FIG. 7(*a*) two magnetostrictive oscillators) are mounted in respective recesses formed in an acoustic wave generating metal tubular member 12.

In order to excite or drive the plurality of magnetostrictive oscillators 26 so as to generate an acoustic wave, there is provided a resonance circuit in which a resonance capacitor 71 is connected in series to the excitation windings 27 in series, as shown in FIG. 10, or in parallel, which are wound around the plurality of magnetostrictive oscillators 26, respectively. An internal resistance 81 is also connected in series to the plurality of excitation windings 27 in series or in parallel.

Therefore, following the next equation (5) described below, the capacitance of the resonance capacitor 71 can be set to a value Crt so that resonance occurs at a given frequency $f_d$ of a voltage supplied to the plurality of excitation windings 27.

$$Crt=1/((2\pi f_d)^2\times L_t) \tag{5}$$

where $L_t$ is the total inductance of the plurality of excitation windings 27 in series, as shown in FIG. 10, or in parallel. Like the resonance circuit of the third embodiment, the impedance of the resonance circuit is thus reduced to its minimum value and hence a desired amount of current can be passed through the resonance circuit through the application of a lower voltage. Consequently, the acoustic wave transmission system can generate an acoustic wave of required amplitude with a smaller amount of electric power.

The resistance value R' of the internal resistor 81 of the resonance circuit can be approximated by the resistances of the plurality of excitation windings 27. If N magnetostrictive oscillators 26 are mounted in the acoustic wave generating metal tubular member 12 and N excitation windings 27 that are respectively wound around the N magnetostrictive oscillators 26 are in series, the impedance of the resonance circuit at the resonance frequency is reduced to its minimum $Z_s$ given by the following equation (6):

$$Z_s=R'=R_1+R_2+\ldots+R_N \tag{6}$$

where $R_1$, $R_2$, . . . , and $R_N$ denote the resistances of the plurality of excitation windings 27, respectively. In contrast, when the N excitation windings 27 are connected in parallel, the impedance of the resonance circuit at the resonance frequency is reduced to its minimum $Z_p$ given by the following equation (7):

$$Z_p=R'=1/(1/R_1+1/R_2+\ldots+1/R_N) \tag{7}$$

As previously mentioned, FIG. 10 shows the circuit structure in the case of N=2.

In a variant, the resonance capacitor 71 and the plurality of excitation windings 27 in series or in parallel can be connected in parallel to each other, instead of connecting them in series. This variant can offer the same advantage as provided by the fourth embodiment mentioned above.

As previously mentioned, in accordance with the fourth embodiment of the present invention, there is provided a resonance circuit in which the plurality of excitation windings 27 respectively wound around the plurality of magnetostrictive oscillators 26 and the resonance capacitor 71 are connected in series or in parallel, and the impedance of the resonance circuit can be reduced to its minimum at the resonance frequency determined by the total inductance of the plurality of excitation windings 27 and the capacitance of the resonance capacitor 71. Accordingly, the fourth embodiment can offer the advantage of being able to generate an acoustic wave with a small amount of electric power and transmit the acoustic wave to the acoustic wave generating metal tubular member 12 with a high degree of efficiency.

Fifth Embodiment

Figure 11:
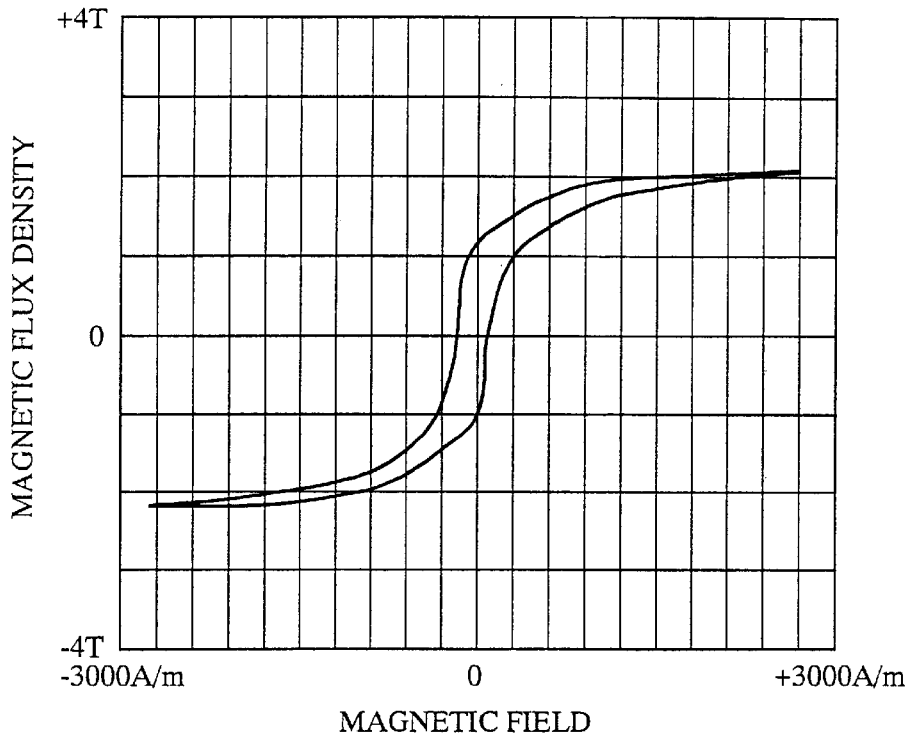
FIG. 11 is a diagram of a curve showing the magnetic saturation of an excitation winding wound around a magnetostrictive oscillator for use in an acoustic wave transmission apparatus according to a fifth embodiment of the present invention.
Figure 13:
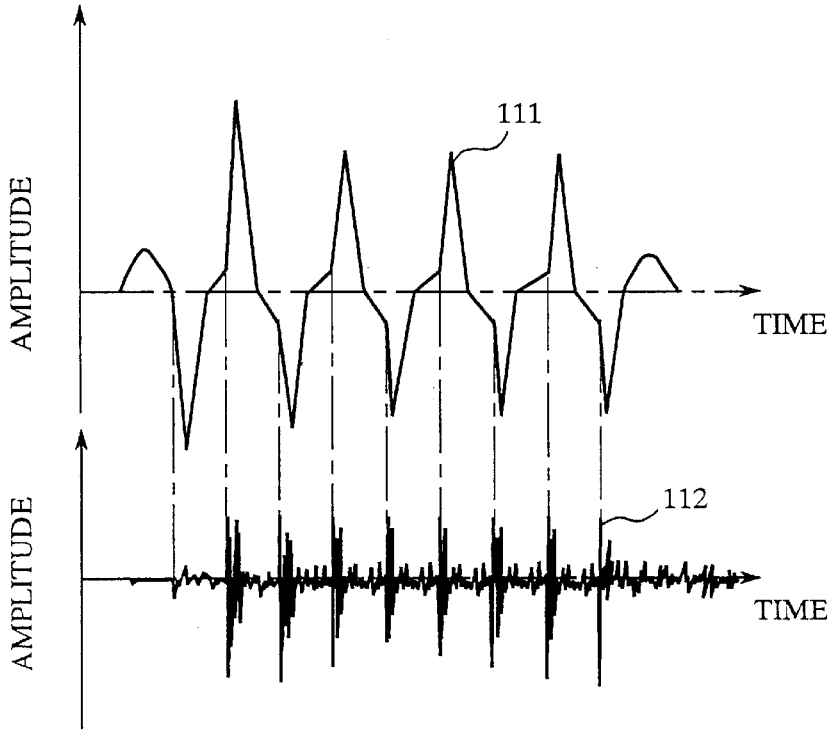
FIG. 13 is a diagram showing the waveforms of the excitation current flowing through the excitation winding wound around the magnetostrictive oscillator for use in the acoustic wave transmission apparatus according to the fifth embodiment of the present invention, and sonic vibrations generated by the magnetostrictive oscillator.
Figure 12:
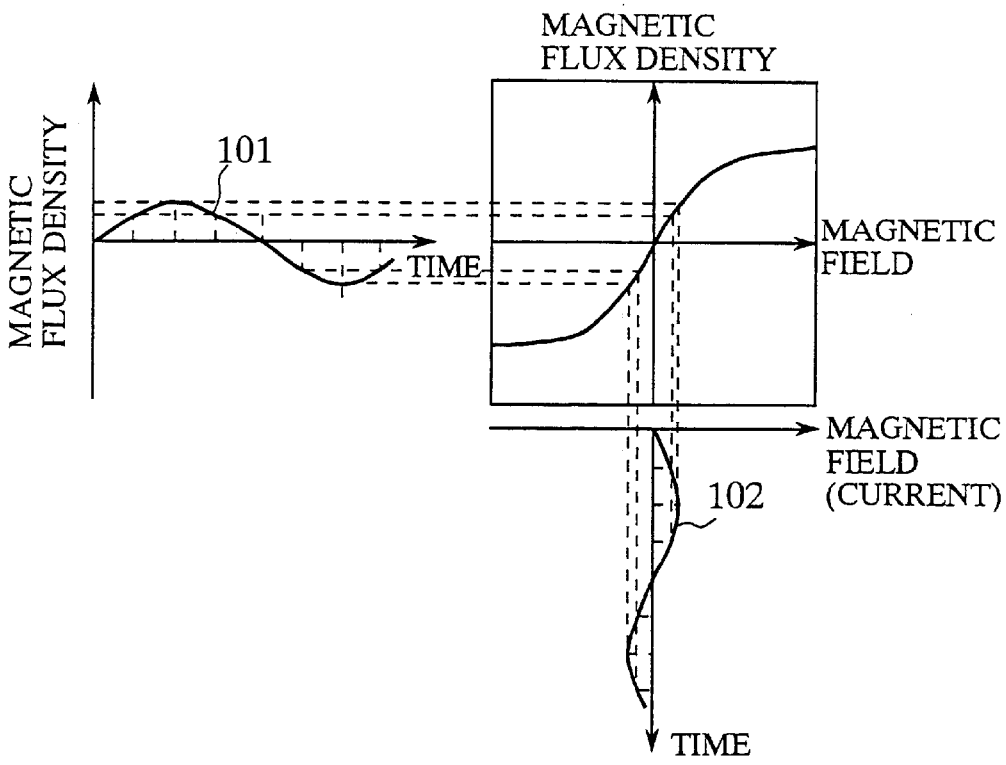
FIG. 12(*a*) is a diagram showing the waveforms of a magnetic flux density applied to the magnetostrictive oscillator for use in the acoustic wave transmission apparatus according to the fifth embodiment of the present invention, and a magnetic field caused by the excitation winding or the current flowing through the excitation winding when the amplitude of the magnetic flux density lies in the linear range of the magnetic saturation curve as shown in FIG. 12(*a*)
Figure 12:
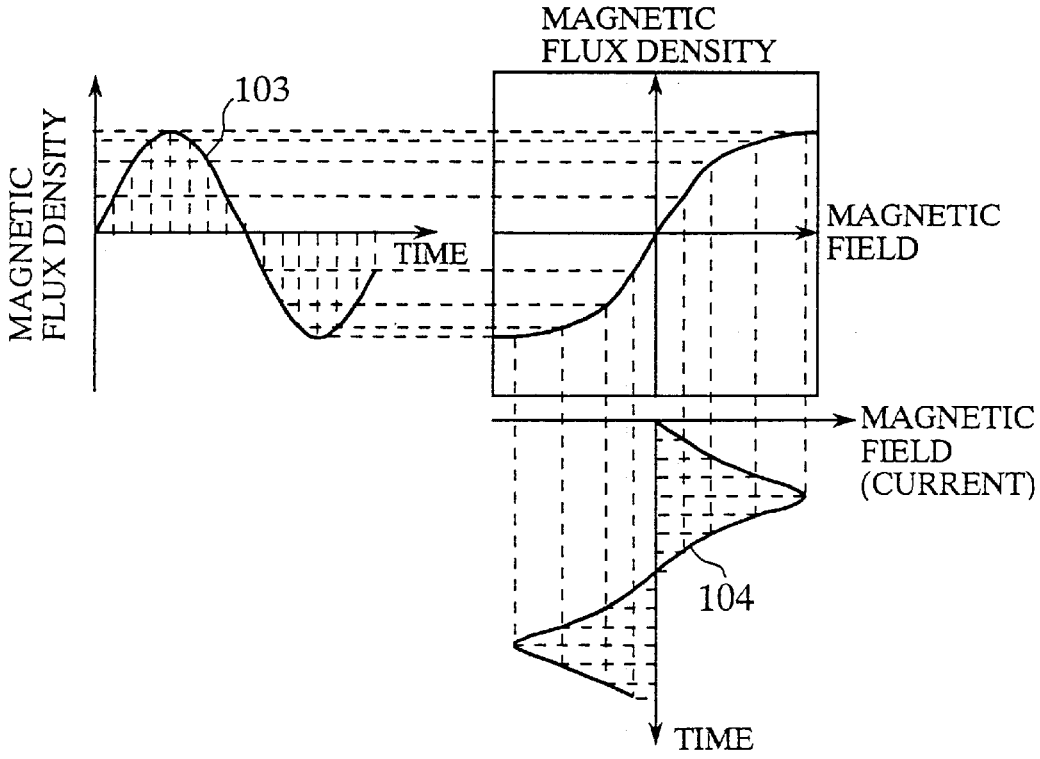
Figure 14:
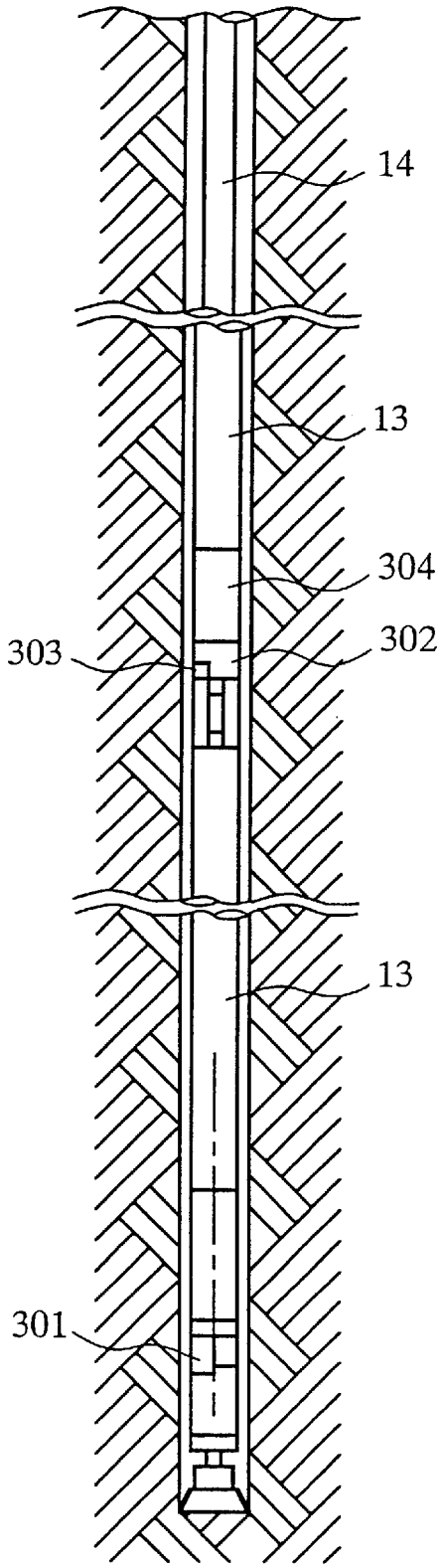
FIG.14 (PRIOR ART)
FIG. 14 is a side view of a prior art acoustic wave transmission system for transmitting an acoustic wave to a drilling metal tubular member.
Figure 15:
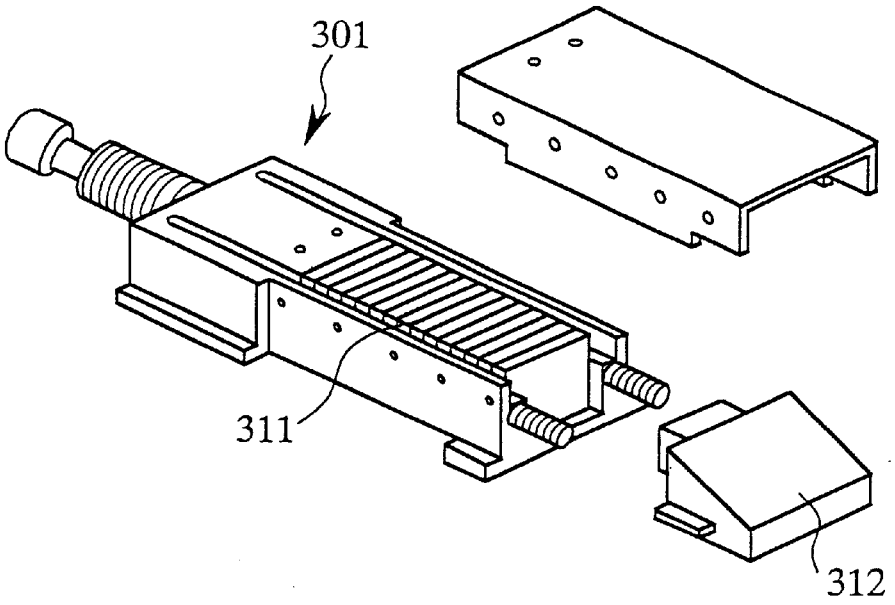
FIG.15 (PRIOR ART)
FIG. 15 is an exploded perspective view showing the structure of an oscillator for use in the prior art acoustic wave transmission system of FIG. 14.

Referring next to FIG. 11, there is illustrated a diagram of a curve showing the magnetic saturation of the excitation winding wound around a magnetostrictive oscillator 26 for use in an acoustic wave transmission system according to a fifth embodiment of the present invention. FIG. 12(*a*) shows the waveforms of a magnetic flux density applied to the magnetostrictive oscillator 26 and a magnetic field caused by the excitation winding or a current flowing through the excitation winding when the amplitude of the magnetic flux density lies in the linear range of the magnetization curve as shown in FIG. 12(*a*). FIG. 12(*b*) shows the waveforms of a magnetic flux density applied to the magnetostrictive oscillator 26 and a magnetic field caused by the excitation winding or a current flowing through the excitation winding when the amplitude of the magnetic flux density reaches the nonlinear range of the magnetization curve as shown in FIG. 12(*b*). FIG. 13 shows the waveforms of the excitation current flowing through the excitation winding wound around the magnetostrictive oscillator 26 of the acoustic wave transmission system according to the fifth embodiment of the present invention, and sonic vibrations generated by the magnetostrictive oscillator 26. In FIG. 12(*a*), reference numeral 101 denotes the waveform of the magnetic flux density varying with time, and 102 denotes the waveform of the magnetic field caused by the excitation winding 27 or the sinusoidal current flowing through the excitation winding 27. In FIG. 12(*b*), reference numeral 103 denotes the waveform of the magnetic flux density varying with time, and 104 denotes the waveform of the magnetic field caused by the excitation winding 27 or the current flowing through the excitation winding 27. In FIG. 13, reference numeral 111 denotes the waveform of the excitation current flowing through the excitation winding 27 of the magnetostrictive oscillator 26, and 112 denotes the waveform of sonic vibrations generated by the magnetostrictive oscillator 26.

There is a relationship between a voltage $V_{in}$ applied to the excitation winding 27 by a voltage source and the magnetic flux Φ excited in the magnetostrictive oscillator 26, which is given by the following equation (8):

$$\Phi=N^*\int V_{in}dt \tag{8}$$

where N is the number of turns of wire in the excitation winding 27.

As can be seen from the above equation, when a sinusoidal voltage is applied to the excitation winding, the magnetic flux Φ varies sinusoidally. The magnitude H of the magnetic field excited by the current I flowing through the excitation winding 27 is calculated from the number N of turns of wire in the excitation winding 27 using the following equation:

$$H=N^*I/l \tag{9}$$

where l is the length of the magnetic path of the excitation winding 27.

A relationship between the magnetic field H excited by the excitation winding 27 of the magnetostrictive oscillator 26 and the magnetic flux Φ that is established when varying the excitation current I is illustrated by a hysteresis loop as shown in FIG. 11. The magnetic flux Φ has a relation with the magnitude H of the magnetic field given by the following equation:

$$\Phi=\mu*S*H \tag{10}$$

where $\mu$ is the permeability of the magnetostrictive material and S is the cross-sectional area of the magnetic path. The amount of excitation current flowing through the excitation winding 27 is thus given by the following equation:

$$I=(l/\mu NS)*\Phi \tag{11}$$

When the amplitude of the magnetic flux density lies in the linear range of the magnetization curve, the excitation current flowing through the excitation winding 27 varies sinusoidally as the magnetic flux 101 varies sinusoidally, as shown in FIG. 12(*a*), because the permeability $\mu$ of the magnetostrictive material is constant. When the excitation current supplier 24 supplies a voltage that is large enough for the magnitude of the magnetic flux density 103 to reach the nonlinear region of the magnetization curve, as shown in FIG. 11, to the excitation winding 27 of the magnetostrictive oscillator 26, the permeability $\mu$ of the magnetostrictive material cannot be maintained constant. As the magnetic flux density reaches the magnetic saturation region, the permeability $\mu$ of the magnetostrictive material is reduced. As a result, the excitation current 104 varies nonlinearly with the magnitude of the magnetic flux density, as shown in FIG. 12(*b*).

When the magnetization curve of the magnetostrictive material constructing the magnetostrictive oscillator 26 has a steep hysteresis property, as shown in FIG. 11, the excitation current flowing through the excitation winding 27 can be a series of spikes 111 as shown in FIG. 13 if the excitation current supplier 24 supplies a voltage of an amplitude enough for the magnitude of the magnetic flux density to reach the nonlinear region of the magnetization curve to the excitation winding 27. The magnetostrictive material undergoes a certain amount of distortion according to the magnitude of the magnetization. When a series of spike current pulses 111 whose amplitude changes largely with time flows through the excitation winding, the magnetization changes abruptly, so that the magnetostrictive oscillator 26 can generate sonic vibrations 112 having a large acceleration as shown in FIG. 13.

As previously explained, in accordance with the fifth embodiment of the present invention, the excitation current supplier can supply an excitation current 111 of large amplitude enough for the magnetostrictive oscillator 26 to be magnetized to saturation. Accordingly, the fifth embodiment of the present invention offers the advantage of being able to generate an acoustic wave having large amplitude.

In either of the above-mentioned first through fifth embodiments of the present invention, the structure of the acoustic wave transmission apparatus intended for oil drilling or natural gas drilling was explained. It should be understood that the acoustic wave generating mechanism 25 of the present invention can be incorporated into a tubular member other than a metal tubular member of the drill string (e.g. a drill collar) as previously mentioned, such as a coiled tubing or a small-diameter pipe, the tubular member being shaped so as to serve as a transmission medium suitable for transmitting an acoustic wave, and therefore an acoustic wave transmission apparatus intended for uses other than oil or natural gas drilling can be easily provided using such the tubular member.

Many widely different embodiments of the present invention may be constructed without departing from the spirit and scope of the present invention. It should be understood that the present invention is not limited to the specific embodiments described in the specification, except as defined in the appended claims.

What is claimed is:

1. An acoustic wave transmission system for generating and transmitting an acoustic wave into a metal member of a drill string, comprising:

an acoustic wave generating metal tubular member for converting information about the bottom of a borehole, which is obtained by a bottom hole sensor, into an acoustic wave, and for furnishing said acoustic wave;

a receiving metal tubular member for receiving said acoustic wave from said acoustic wave generating metal tubular member by way of said drill string;

a demodulator for demodulating said acoustic wave received by said receiving metal tubular member so as to extract the information about the bottom of the borehole;

said acoustic wave generating metal tubular member including acoustic wave generating means having at least a magnetostrictive oscillator which is mounted in a recess formed in an outer wall of said acoustic wave generating metal tubular member, and on which a compressive load is imposed by means of a pre-load mechanism using a vise, said magnetostrictive oscillator being constructed of a stack of thin plates each made of a metal magnetostrictive material having a property of increasing its dimensions when magnetized, said thin plates being bonded together by a heat-resistant adhesive, and said magnetostrictive oscillator thus having a buckling strength large enough to resist the compressive load imposed thereon by said pre-load mechanism and a stress due to a strain caused in itself; and said acoustic wave generating metal tubular member further including excitation current supplying means for supplying either a rectangular, sinusoidal, or triangular alternating excitation current modulated with said information about the bottom of the borehole and having a frequency that is half a carrier frequency of said acoustic wave, or a series of excitation pulses modulated with said information about the bottom of the borehole and having a pulse repetition rate that is equal to said carrier frequency of said acoustic wave, to an excitation winding wound around said magnetostrictive oscillator, so as to cause said magnetostrictive oscillator to generate and transmit an acoustic wave having an arbitrary frequency into said acoustic wave generating metal tubular member.

2. The acoustic wave transmission system according to claim 1, wherein a drill collar serves as said acoustic wave generating metal tubular member.

3. The acoustic wave transmission system according to claim 1, wherein said acoustic wave generating means includes a plurality of magnetostrictive oscillators which are mounted in respective recesses formed in the outer wall of said acoustic wave generating metal tubular member and on which compressive loads are imposed respectively by means of said pre-load mechanism using a plurality of vises.

4. The acoustic wave transmission system according to claim 1, wherein said acoustic wave generating means includes a resonance capacitor connected in series or parallel to said excitation winding wound around said magnetostrictive oscillator, said resonance capacitor having a capacitance which is predetermined such that a resonance frequency defined by the inductance of said excitation winding and the capacitance of said resonance capacitor is half said carrier frequency of said acoustic wave.

5. The acoustic wave transmission system according to claim 1, wherein said excitation current supplying means supplies an excitation current that is large enough to cause said magnetostrictive oscillator to be magnetized to saturation.

6. The acoustic wave transmission system according to claim 3, wherein said acoustic wave generating means includes a resonance capacitor connected in series or parallel to a plurality of excitation windings in series or in parallel, which are respectively wound around said plurality of magnetostrictive oscillators, said resonance capacitor having a capacitance which is predetermined such that a resonance frequency defined by the total inductance of said plurality of excitation windings and the capacitance of said resonance capacitor is half said carrier frequency of said acoustic wave.

7. A method of generating and transmitting an acoustic wave into a metal member of a drill string, including the steps of converting information about the bottom of a borehole, which is obtained by a bottom hole sensor, into an acoustic wave, receiving said acoustic wave by way of said drill string at the ground, and demodulating said acoustic wave received so as to extract the information about the bottom of the borehole; said method further comprising the steps of:

providing at least a magnetostrictive oscillator, which is mounted in a recess formed in an outer wall of a metal member of said drill string, while imposing a compressive load on said magnetostrictive oscillator mounted in said recess by means of a pre-load mechanism using a vise, said magnetostrictive oscillator being constructed of a stack of thin plates each made of a metal magnetostrictive material having a property of increasing its dimensions when magnetized, said thin plates being bonded together by a heat-resistant adhesive, and said magnetostrictive oscillator thus having a buckling strength large enough to resist the compressive load imposed thereon by said pre-load mechanism and a stress due to a strain caused in itself; and supplying either a rectangular, sinusoidal, or triangular alternating excitation current modulated with said information about the bottom of the borehole and having a frequency that is half a carrier frequency of said acoustic wave, or a series of excitation pulses modulated with said information about the bottom of the borehole and having a pulse repetition rate that is equal to said carrier frequency of said acoustic wave, to an excitation winding wound around said magnetostrictive oscillator, so as to cause said magnetostrictive oscillator to generate and transmit an acoustic wave having an arbitrary frequency into said metal member of said drill string.

* * * * *